United States Patent [19]

Hultquist

[11] Patent Number: 5,050,921

[45] Date of Patent: Sep. 24, 1991

[54] CLAMP WITH DETACHABLE CAM

[76] Inventor: John V. Hultquist, 10500 Westminster #13, Garden Grove, Calif. 92643

[21] Appl. No.: 609,717

[22] Filed: Nov. 6, 1990

[51] Int. Cl.[5] ..... B66C 1/48; B66C 1/64

[52] U.S. Cl. ..... 294/118; 294/116

[58] Field of Search ..... 294/16, 82.12, 85, 86.4, 294/101, 104, 106, 108–110.1, 116–119

[56] References Cited

U.S. PATENT DOCUMENTS

| | | | |
|---|---|---|---|
| 84,683 | 12/1868 | Dewey | 294/106 X |
| 742,922 | 11/1903 | Snowden | 294/106 X |
| 1,184,367 | 5/1916 | Moore | 294/117 |
| 1,317,808 | 10/1919 | Mohr | 294/118 X |
| 1,580,083 | 4/1926 | Boadle | 294/86.4 X |
| 2,613,103 | 10/1952 | Bushnell | 294/106 |
| 2,961,269 | 11/1960 | Renfroe | 294/85 |
| 3,870,359 | 3/1975 | Hultquist | 294/118 |
| 4,740,024 | 4/1988 | Hultquist | 294/118 X |
| 4,832,392 | 5/1989 | Butler | 294/82.12 |
| 4,869,540 | 9/1989 | Faul | 294/118 X |

*Primary Examiner*—Johnny D. Cherry

*Attorney, Agent, or Firm*—Dean P. Edmundson

[57] ABSTRACT

An improved tong-type clamp is described which includes a cam pivotally attached to one of the clamping members. The cam is detachable so that the cam can be removed. Then the clamp can be opened to any desired extent (e.g., to allow the clamping jaw to be extended around an enlarged portion of an object to be clamped), after which the cam can be attached to the clamping member again.

6 Claims, 3 Drawing Sheets

CLAMP WITH DETACHABLE CAM

FIELD OF THE INVENTION

This invention relates to clamps. More particularly, this invention relates to tong-type clamps in which a pair of clamping members are pivotally connected to each other intermediate their ends. Even more particularly, this invention relates to tong-type clamps having a locking cam member.

BACKGROUND OF THE INVENTION

In my prior U.S. Pat. Nos. 3,870,350 and 4,740,024 there are described tong-type clamps which have a variety of uses. These clamps include a pair of clamping members which are pivotally connected to one another intermediate their ends. The portions of the clamping members extending in one direction from the pivot connection serve as handles for the clamp and the portions of the members extending in the other direction from the pivot connection serve as the clamping arms.

The clamping arms terminate in facing clamping jaws which are adapted to grip a workpiece therebetween. As the handles are moved toward one another the clamping arms correspondingly move together.

A locking cam is carried by one of the clamping members. The cam is pivotally attached to the clamping member and is adapted to be rotated in a manner such that its peripheral surface engages one of the handle members to prevent the clamp from opening when the clamp is connected to a workpiece. When the cam member is rotated in the opposite direction, the peripheral surface is moved away from the handle and allows the clamp to be opened to release the clamp from the workpiece.

One problem with the foregoing types of clamps is that the clamping jaws are limited in the extent to which they can be opened. Because the cam member is carried on one of the clamping members, it limits the extent to which the handle members can be moved apart. As a result, there is an inherent limitation in such types of clamps regarding the width of the opening between the clamping jaws when the clamp is fully opened. Consequently, such types of clamps are limited in terms of the size of workpieces onto which they can be positioned.

There has not heretofore been provided a tong-type clamp with locking cam which can be opened to any desired extent.

SUMMARY OF THE PRESENT INVENTION

In accordance with the present invention there is provided an improved tong-type clamp in which two clamping members are pivotally connected to each other intermediate their ends. A cam member is pivotally carried by one of the clamping members for engagement with the handle of the other clamping member to hold the clamping jaws in clamped position upon clamping a workpiece therebetween. The cam member is detachably connected or mounted on the clamping member so that the cam member can be quickly and easily detached. This allows the clamping jaws to be opened to a much greater extent than when the cam member is attached.

By opening the jaws to a wider position, the jaws can be extended around an enlarged object to reach another object positioned behind the first object. Also, sometimes an object includes an enlarged portion which must be reached around with a clamp in order to reach another portion of the object which must be gripped by the clamp.

The improved clamp of this invention has a variety of uses. Other advantages of the improved clamp will be apparent from the following detailed description.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
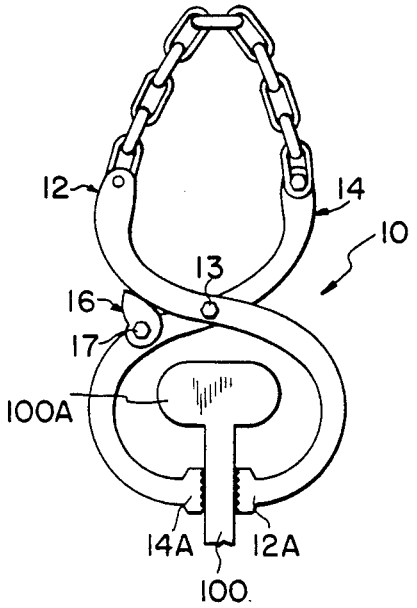
FIG. 1 is a front elevational view of one embodiment of improved clamp of this invention.

In FIG. 1 there is shown a front elevational view of one embodiment of tong-type clamp 10 of the invention which includes clamping members 12 and 14 pivotally connected intermediate their ends by means of bolt or pin 13. The lower portions of the clamping members terminate in facing clamping jaws 12A and 14A. The clamp is shown securing and gripping a workpiece 100 which has an enlarged portion 100A which must be reached around by the clamp. Cam member 16 is pivotally attached to clamping member 14 by means of a bolt or pin having on its upper end a nut 17. When the jaws are closed around a desired object, the cam member 16 can be pivoted or rotated so that the peripheral surface of the cam contacts the handle of the other clamping member. This locks the clamp in closed position.

Figure 5:
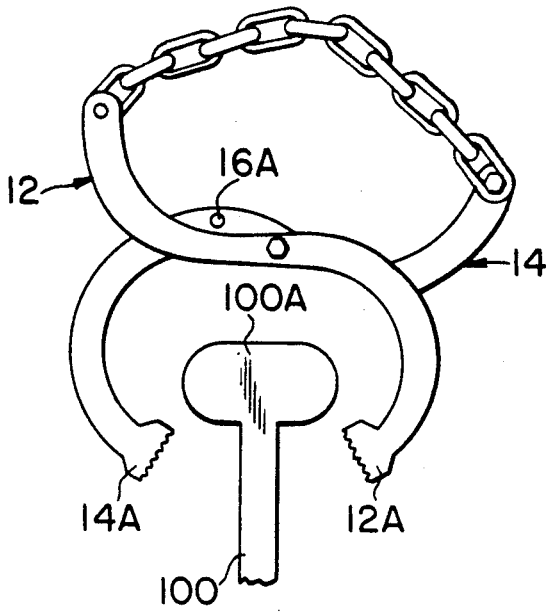
FIG. 5 is a front view showing the clamp of FIG. 1 with the cam member removed to allow the clamp to be fully opened.

The cam member 16 is detachably connected to the clamping member so that the cam ca be removed completely from the clamp. Then the clamp can be opened to a much greater extent than when the cam is attached. This is illustrated in FIG. 5 where the cam has been detached from aperture 16A in clamping member 14. This allows the jaws to be opened sufficiently wide to extend around the enlarged portion 100A of object 100. Then the handles of the clamp can be drawn towards each other to enable the cam member to be inserted into aperture 16A again.

Figure 2:
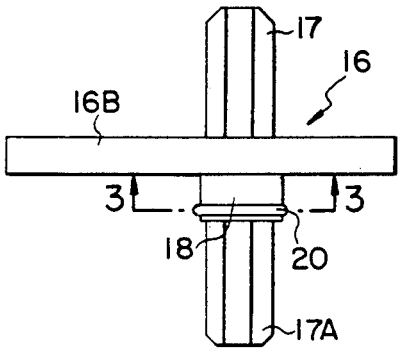
FIG. 2 is an elevational view of the cam member used in clamps of the invention.
Figure 3:
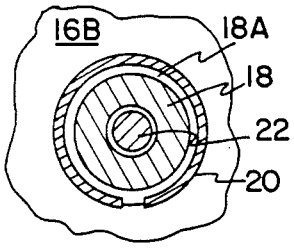
FIG. 3 is a cross-sectional view taken along line 3—3 in FIG. 2.
Figure 4:
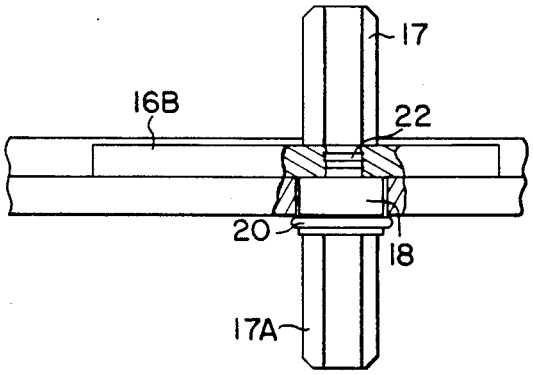
FIG. 4 is a side elevational view, partially cut-away, showing the cam member on the clamp of FIG. 1.

FIGS. 2, 3 and 4 illustrate a preferred embodiment of cam member 16 of this invention. The cam includes cam portion 16B having a non-circular peripheral surface. Nut member 17 on the upper side, and nut member 17A on the lower side, are adapted to pivot or rotate the cam as desired (e.g., by means of a wrench). Preferably the nut members have a hexagonal cross-section.

Bushing 18 has a circular cross-section and is adapted to be received in aperture 16A in clamping member 14. Bushing 18 enables the cam to pivot or rotate relative to clamping member 14.

The lower end of bushing 18 includes an annular groove 18A. A split ring 20 is carried in the groove. The ring normally has an outer diameter slightly larger than the diameter of bushing 18, but the ring can be compressed into groove 18A to enable the bushing to pass through the aperture 16A. When the split ring expands to its normal size, it retains the cam in position but does not interfere with pivoting or rotation of the cam to lock the clamp in its closed position.

Shank member 22 is threaded. Nut 17 is threaded onto the upper end of the shank and nut 17A is threaded onto the lower end of the shank. The cam portion 16B also threadably engages the shank 22. In this manner the cam portion 16B can be rotated by turning either nut 17 or nut 17A.

Instead of using separate nuts, shank, cam portion and bushing, it is possible to cast the entire cam as an integral unit. Then the split ring can be fitted onto the bushing.

Figure 6:
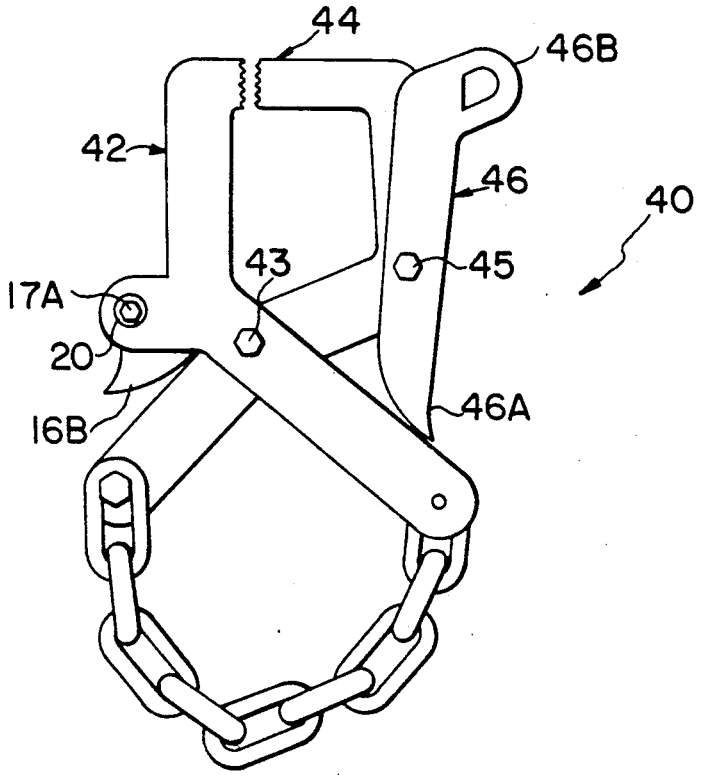
FIG. 6 is a front view of another embodiment of improved clamp of the invention.

FIG. 6 illustrates another embodiment of clamp 40 of the invention comprising clamping members 42 and 44 which are pivotally connected to each other intermediate their ends by means of bolt 43. A cam portion 16B is pivotally connected to clamping member 42 as illustrated. Pulling arm 46 is pivotally connected to clamping member 44 by means of bolt 45. End 46A of arm 46 bears against the handle portion of clamping member 42 when pulling force is applied to the end 46B of arm 46.

The cam ca be detached from clamping member 42 to enable the jaws of the clamp to be opened to a much greater extent (e.g., to enable the jaws to reach around an enlarged portion of an object to reach a gripping surface). Then the cam can be attached to the clamp again for its normal use.

Figure 7:
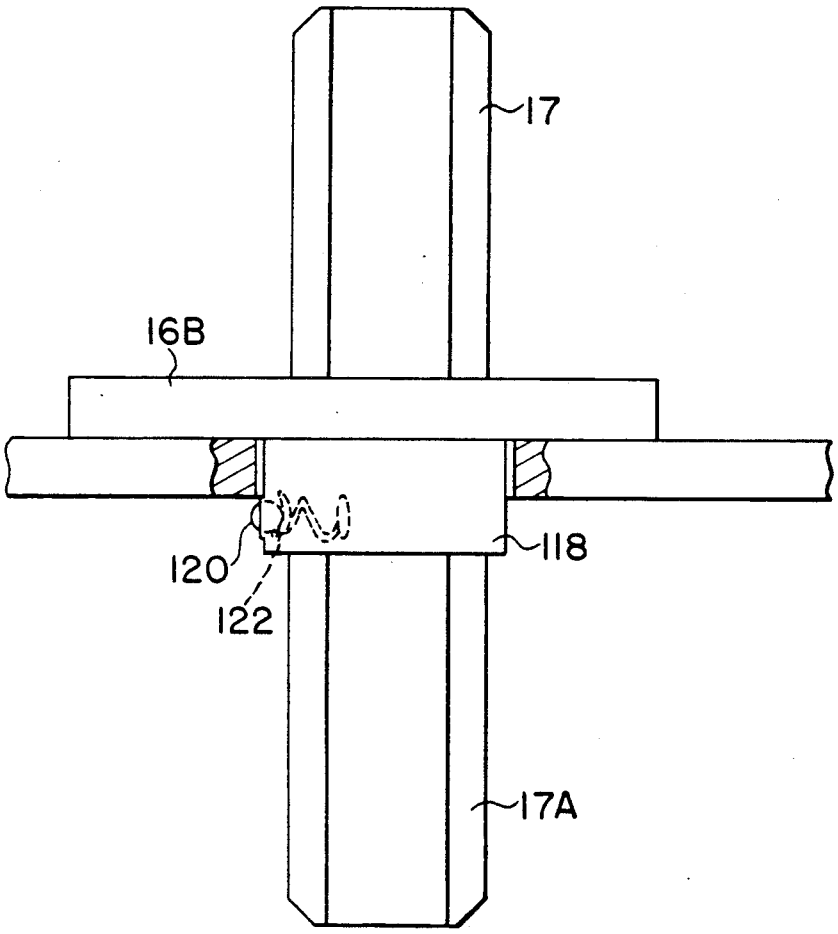
FIG. 7 is a side elevational, partially cut-away view showing another manner in which the cam may be detachably mounted.

Other variants are possible without departing from the scope of this invention. For example, the cam member could be retained in the aperture in the clamping member by a spring or by means of a ball or protrusion which is biased outwardly away from one side of the bushing. This is illustrated in FIG. 7 where ball 120 is carried by the bushing 118 and is biased outwardly by means of spring 122. The ball is urged inwardly against the spring in order to enable the bushing 118 and cam 16B to be detached from the clamping member. Other variants are also possible.

What is claimed is:

1. In a clamp of the type having first and second clamping members pivotally attached to one another intermediate their ends, wherein the portions of said members to one side of the pivotal attachment comprise arms terminating in facing clamping jaws, and wherein the portions of said members to the other side of the pivotal attachment comprise handle elements, and wherein cam means is pivotally carried by said first clamping member for engagement with the handle element of said second clamping member to hold the clamping jaws in clamped position upon clamping a workpiece therebetween; wherein the improvement comprises said cam means being detachably mounted on said first clamping member; wherein said first clamping member includes an aperture therethrough; wherein said cam means comprises:

(a) a cam member having a peripheral surface;

(b) mounting means carried by said cam member for pivotally mounting said cam member to said first clamping member; wherein said mounting means further includes (i) a shank member secured to said cam member, and (ii) a bushing member surrounding said shank member, wherein said bushing member has a circular cross-section; wherein said bushing member includes an annular groove and a split ring carried in said groove; wherein said split ring is capable of being compressed into said groove in order to enable said bushing member to pass through said aperture in said first clamping member.

2. The improvement in accordance with claim 1, wherein said shank member includes first and second ends; wherein said shank member further includes a first nut member secured to said first end of said shank member and a second nut member secured to said second end of said shank member.

3. The improvement in accordance with claim 1, further comprising an elongated pull bar having first and second ends and being pivotally attached intermediate its ends to one of said arms; wherein said first end of said pull bar includes attachment means; wherein said second end of said pull bar is adapted to be biased against one of said handle elements in a manner such that when said first end of said pull bar is pulled in an outward direction, then said second end of said pull bar is biased against said one handle element to force said clamping jaws towards each other.

4. In a clamp of the type having first and second clamping members pivotally attached to one another intermediate their ends, wherein the portions of said members to one side of the pivotal attachment comprises arms terminating in facing clamping jaws, and wherein the portions of said members to the other side of the pivotal attachment comprises handle elements, and wherein cam means is pivotally carried by said first clamping member for engagement with the handle element of said second clamping member to hold the clamping jaws in clamped position upon clamping a workpiece therebetween; wherein said first clamping member includes an aperture therethrough; wherein the improvement comprises cam means which comprises:

(a) a cam member having a peripheral surface;

(b) mounting means carried by said cam member for pivotally mounting said cam member to said first clamping member; wherein said mounting means enables said cam member to pivot relative to said first clamping member; wherein said mounting means further includes (i) a shank member secured to said cam member, and (ii) a bushing member surrounding said shank member, wherein said bushing member has a circular cross-section; wherein said bushing member further includes a ball member which is biased outwardly, wherein said ball member is capable of being moved inwardly in order to enable said bushing member to pass through said aperture in said first clamping member.

5. The improvement in accordance with claim 4, wherein said shank member includes first and second ends; wherein said shank member further includes a first nut member secured to said first end of said shank member and a second nut member secured to said second end of said shank member.

6. The improvement in accordance with claim 4, wherein further comprising an elongated pull bar having first and second ends and being pivotally attached intermediate its ends to one of said arms; wherein said first end of said pull bar includes attachment means; wherein said second end of said pull bar is adapted to be biased against one of said handle elements in a manner such that when said first end of said pull bar is pulled in an outward direction, then said second end of said pull bar is biased against said one handle element to force said clamping jaws towards each other.

* * * * *